US009272559B2

(12) United States Patent
Nishijima

(10) Patent No.: US 9,272,559 B2
(45) Date of Patent: Mar. 1, 2016

(54) COLOR ERASING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Takeo Nishijima, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/287,805

(22) Filed: May 27, 2014

(65) Prior Publication Data

US 2015/0343824 A1 Dec. 3, 2015

(51) Int. Cl.
*B41M 7/00* (2006.01)
*B41M 5/34* (2006.01)

(52) U.S. Cl.
CPC . *B41M 5/34* (2013.01); *B41M 7/00* (2013.01); *B41M 7/009* (2013.01); *B41M 7/0009* (2013.01)

(58) Field of Classification Search
USPC ..... 347/179
See application file for complete search history.

(56) References Cited

U.S. PATENT DOCUMENTS

| | | | | |
|---|---|---|---|---|
| 8,922,608 | B2 * | 12/2014 | Mizutani | 347/179 |
| 9,001,384 | B2 * | 4/2015 | Megawa et al. | 358/1.9 |
| 9,036,201 | B2 * | 5/2015 | Hagiwara | 358/1.9 |
| 2008/0192618 | A1 * | 8/2008 | Nakata et al. | 369/120 |
| 2011/0317198 | A1 | 12/2011 | Suzuki | |

FOREIGN PATENT DOCUMENTS

| | | | |
|---|---|---|---|
| JP | 4-356088 | * 12/1992 | G03G 21/00 |

* cited by examiner

*Primary Examiner* — Huan Tran
(74) *Attorney, Agent, or Firm* — Amin, Turocy & Watson, LLP

(57) ABSTRACT

In accordance with one embodiment, a color erasing apparatus capable of erasing the color of an image formed with a color erasable material on a sheet comprises a color erasing section configured to erase the color of an image formed on the sheet; a control panel configured to set a reading area of the sheet; and a reading section configured to read the image of the area set on the sheet and determine the state of the image erased by the color erasing section.

20 Claims, 4 Drawing Sheets

COLOR ERASING APPARATUS

FIELD

Embodiments described herein relate to a color erasing apparatus capable of changing a criterion for reuse of a sheet printed with a color erasable material.

BACKGROUND

Conventionally, the characters or images printed on a sheet on which there is a hole generated in stapling processing or a punched hole can be color-erased by the color erasing apparatus.

However, in the color erasing apparatus which comprises a sorting function for sorting reusable sheets and non-reusable sheets according to the color erasing state of the sheet, a color erasing processing is carried out on a sheet having a staple hole or a punched hole, and then the sheet is determined to be not reusable by the sorting function. Therefore, there is a problem that it is inconvenient for a user who desires to reuse a sheet even though there is a staple hole or a punched hole on the sheet.

DETAILED DESCRIPTION

In accordance with one embodiment, a color erasing apparatus capable of erasing the color of an image formed with a color erasable material on a sheet comprises a color erasing section configured to erase the color of an image formed on the sheet; a control panel configured to set a reading area of the sheet; and a reading section configured to read the image of the area set on the sheet and determine the state of the image erased by the color erasing section.

Hereinafter, the embodiment is described in detail with reference to the accompanying drawings.

Figure 1:
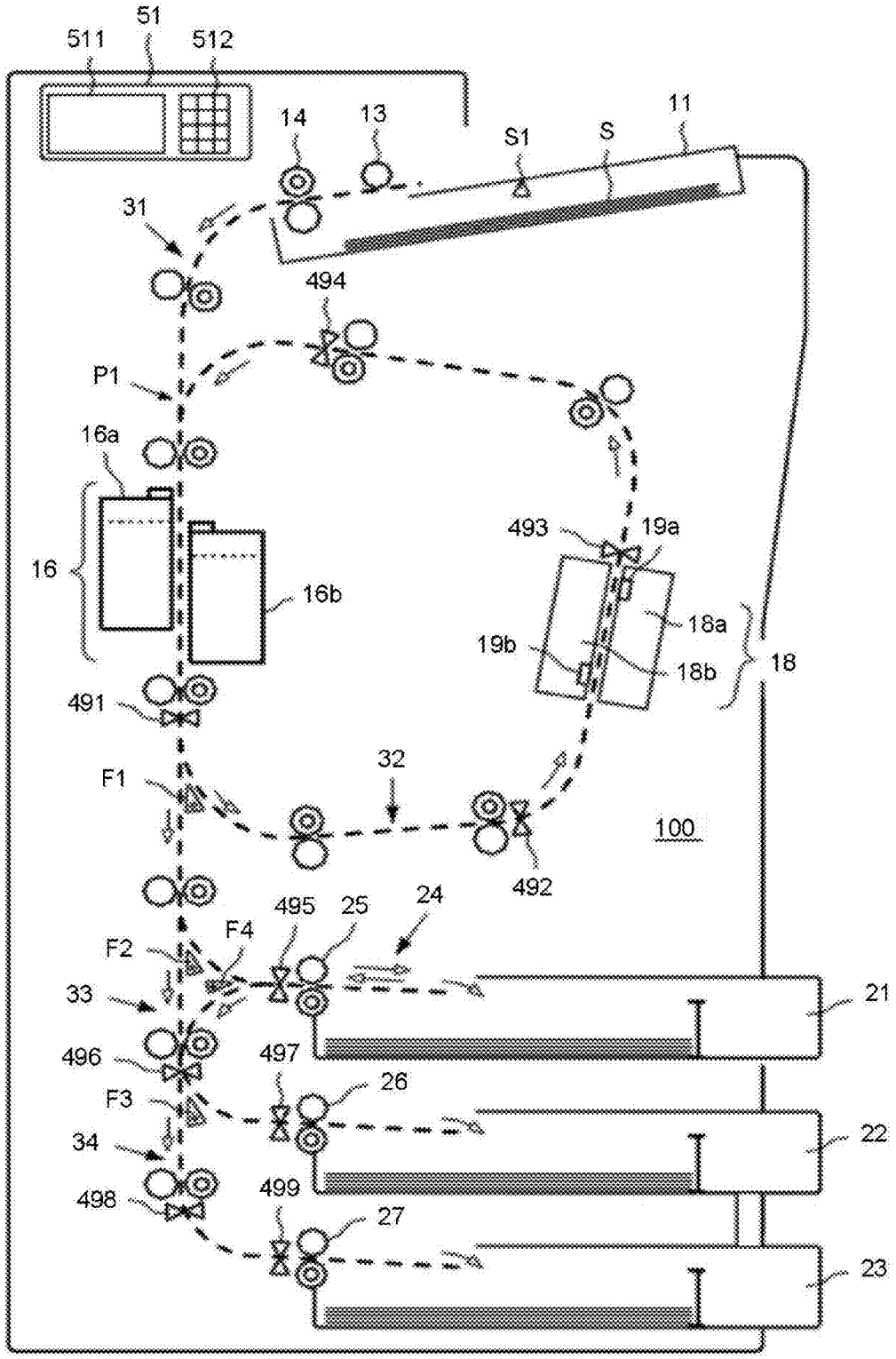
FIG. 1 is a schematic system constitution diagram illustrating a color erasing apparatus according to one embodiment.

FIG. 1 is a schematic system constitution diagram illustrating a color erasing apparatus according to the embodiment.

A color erasing apparatus 100 carries out a "color erasing processing" of erasing the color of an image formed with a color erasable material on a sheet on which the image is formed with a "color erasable material" such as color erasable toner or color erasable ink and the like. The color erasable material includes a color generation compound, a color developing agent and a color erasing agent. As the color generation compound, for example, a leuco dye can be listed. As the color developing agent, for example, phenols can be listed. As the color erasing agent, a substance which compatibilizes with the color generation compound when being heated, and furthermore, does not have affinity with the color developing agent can be listed. The color erasable material generates a color through the interaction of the color generation compound and the color developing agent, and as the interaction of the color generation compound and the color developing agent is eliminated by the heating above a color erasing temperature, the color of the color erasable material is erased. The color erasable material is referred to as a recording material for short in the following description.

The color erasing apparatus 100 is provided with a paper feed tray 11, paper feed components 13 and 14, a reading section 16, a color erasing section 18, a both sides reusable paper tray 21, an single side reusable paper tray 22, a rejected paper tray 23, discharge rollers 25, 26 and 27, a first conveyance path 31, a second conveyance path 32, a third conveyance path 33, a fourth conveyance, path 34, a first flapper F1, a second flapper F2, a third flapper F3, a fourth flapper F4 and a control panel 51. The first-fourth flappers F1-F4 are capable of rotating clockwise or anticlockwise so as to control a conveyance direction of a sheet.

The paper feed tray 11 feeds a sheet S for reuse. Sheets of various sizes, such as A4, A3, B5, are stored in the paper feed tray 11. An image is formed on the sheet S with recording material the color of which is erased by, for example, heating to above a given temperature. The paper feed components 13 and 14 consisting of a pickup roller, a sheet feed roller, a separation roller arranged opposite to the sheet feed roller, and the like, feed sheets on the paper feed tray 11, one by one, to the first conveyance path 31 insides the color erasing apparatus 100.

The paper feed tray 11 further comprises a detection sensor S1 for detecting the existence of a sheet on the paper feed tray 11. The detection sensor S1 may be, for example, a micro sensor or a micro actuator. The first conveyance path 31 forms a conveyance path from the paper feed tray 11 towards the both sides reusable paper tray 21 to convey a fed sheet S to the reading section 16 or the both sides reusable paper tray 21.

The reading section 16 is arranged at the downstream side of the paper feed tray 11 in the sheet conveyance direction along the first conveyance path 31. The reading section 16 includes a reading unit such as a CCD (Charge Coupled Device) scanner or a CMOS (Complementary Metal Oxide Semiconductor) sensor and the like. The reading section 16 according to the present embodiment reads the images on a first (front) side and a second (rear) side of a conveyed sheet, respectively. That is, the reading section 16 includes a first reading unit 16*a* and a second reading unit 16*b* which are arranged opposite to each other across the first conveyance path 31. The reading section 16 is at such a position relation that the both sides of the conveyed sheet can be read.

The image read by the reading section 16 is stored in a storage section 522 (refer to FIG. 2) which will be described later. For example, the image on the sheet read by the reading section 16 before a color erasing processing is carried out is computerized and stored in the storage section 522, thus, the image data can be acquired if the data of the color-erased image is needed later. Further, a control section 52 (refer to FIG. 2) described later determines whether or not the sheet is color-erasable, alternatively, determines whether or not the sheet is reusable, based on the image read by the reading section 16.

The first flapper F1 is arranged at the downstream side of the reading section 16 as a switching section to switch the conveyance direction of the conveyed sheet S. The first flapper F1 sorts the sheets S conveyed in the first conveyance path 31 so as to convey the sheets to the second conveyance path 32 or the reusable paper tray 21. The second conveyance path 32 branches off from the first conveyance path 31 at a branch point where the first flapper F1 is arranged. The second conveyance path 32 branching off at the branch point conveys the sheet to the color erasing section 18.

Further, the second conveyance path 32 merges with the first conveyance path 31 at a mergence point P1 which is located at the upstream side of the reading section 16 in the sheet conveyance direction. That is, the second conveyance path 32 merges with the first conveyance path 31 at the mergence point P1 between the paper feed tray 11 and the reading section 16. Thus, the second conveyance path 32 is capable of conveying the sheet conveyed from the reading section 16 to the reading section 16 again via the color erasing section 18. In other words, the color erasing apparatus 100 can control the first flapper F1 so as to convey the sheet S fed from the paper feed tray 11 to the reading section 16, the color erasing section 18, and then to the reading section 16 in sequence.

The first conveyance path 31 is provided with the second flapper F2 at the downstream side of the first flapper F1. The second flapper F2 guides the sheet S conveyed from the first flapper F1 to the both sides reusable paper tray 21 or the third conveyance path 33. The third conveyance path 33 conveys the sheet towards the single side reusable paper tray 22.

The third conveyance path 33 is provided with the third flapper F3 at the downstream side of the second flapper F2. The third flapper F3 guides the sheet S conveyed through the second flapper F2 to the fourth conveyance path 34. The fourth conveyance path 34 conveys the sheet S to the rejected paper tray 23.

The color erasing section 18 erases the color of the image formed on the conveyed sheet S. For example, the color erasing section 18 heats the sheet S to a given color erasing temperature in a state of contacting with the conveyed sheet S, so as to erase the color of the image formed on the sheet S with recording material. For example, the color erasing section 18 of the color erasing apparatus 100 includes two color erasing units 18*a* and 18*b* for erasing the colors of the first side and the second side of the sheet. The color erasing units 18*a* and 18*b* are arranged opposite to each other across the second conveyance path 32.

The color erasing unit 18*a* contacts with and heats the sheet from one side of the sheet. The color erasing unit 18*b* contacts with and heats the sheet from the other side of the sheet. The color erasing section 18 erases the colors of the images on both sides of the conveyed sheet synchronously. A position where the color erasing units 18*a* and 18*b* heats the sheet to erase the color of the image is referred to as a color erasing position. The color erasing section 18 comprises temperature sensors 19*a* and 19*b* for detecting the temperature of heating sections of the color erasing units 18*a* and 18*b*, respectively. The temperature sensors 19*a* and 19*b* may be contact-type or contactless-type sensors.

The control panel 51 arranged at the upper portion of the main body of the color erasing apparatus 100 includes a touch panel type display section 511 and various operation keys 512. The operation keys 512 include, for example, a numeric keypad, a stop key, a start key and the like. A user instructs, through the control panel 51, the functional operations of the color erasing apparatus 100 such as the start of the color erasing processing, the reading of the image on the sheet to be color-erased. The display section 511 displays setting information and operation status of the color erasing apparatus 100, log information, or a message for the user.

The control panel 51 is not limited to be arranged on the main body of the color erasing apparatus 100. For example, it may also be such a constitution in which operations can be carried out from the control panel 51 of an external device connected with the color erasing apparatus 100 through a network. Alternatively, it is such a constitution that the control panel 51 is independent from the main body of the color erasing apparatus, and the color erasing apparatus 100 is operated through a wired or wireless communication. The control panel 51 may also be a device through which a processing instruction, information browsing and the like to the color erasing apparatus 100 can be carried out.

The discharge rollers 25, 26 and 27 discharge the sheets S to the both sides reusable paper tray 21, the single side reusable paper tray 22 and the rejected paper tray 23 arranged at the lower portion of the main body. For example, the both sides reusable paper tray 21 stacks the sheet the images on which are color-erased and both sides of which are reusable. The single side reusable paper tray 22 stacks the sheet only one side of which is determined to be reusable. The rejected paper tray 23 stacks the sheet both sides of which are determined to be not reusable. In addition, the sheet only one side of which is determined to be reusable is subjected to a marking processing by a stamp device (not shown) to add a mark indicating "not reusable" to the non-reusable side. In this way, the user is notified of a message that the marked side cannot be reused.

The discharge roller 25 has a function of discharging the both sides reusable sheet to the both sides reusable paper tray 21, and stacking the sheet in the both sides reusable paper tray 21. The discharge roller 25 comprises a sheet reversal section 24 which switches back and reverses, in a case where the sheet is determined to be a single side reusable sheet, the sheet so that the reusable sides of the sheets face to the same direction in the single side reusable paper tray 22.

There is a case where the sheet is directly conveyed to the third conveyance path 33 from the first conveyance path 31 and then stacked in the single side reusable paper tray 22, and a case where the sheet is temporarily conveyed to the both sides reusable paper tray 21, and then reversed and stacked in the single side reusable paper tray 22. In this way, the sheets are stacked in the single side reusable paper tray 22 in such a state in which, for example, the reusable single sides of the sheets face upwards.

In addition, the both sides reusable paper tray 21, the single side reusable paper tray 22 and the rejected paper tray 23 may switch between the sheets to be stacked. The setting about each tray stacking what kind of sheets, that is, the setting of the conveyance destinations of the sheets may be carried out from, for example, the control panel 51.

The second flapper F2 switches between the conveyance paths and guide the conveyed sheet to the both sides reusable paper tray 21 or the third conveyance path 33 according to the setting. The third flapper F3 switches between the conveyance paths and guide the conveyed sheet to the single side reusable paper tray 22 or the fourth conveyance path 34.

The color erasing apparatus 100 is provided with a plurality of sheet detection sensors 491-499 for detecting the sheets conveyed in the first-fourth conveyance paths 31-34. The sheet detection sensors 491-499 may be, for example, micro sensors or micro actuators. The sheet detection sensors 491-499 are arranged at proper positions of the first-fourth conveyance paths 31-34.

Figure 2:
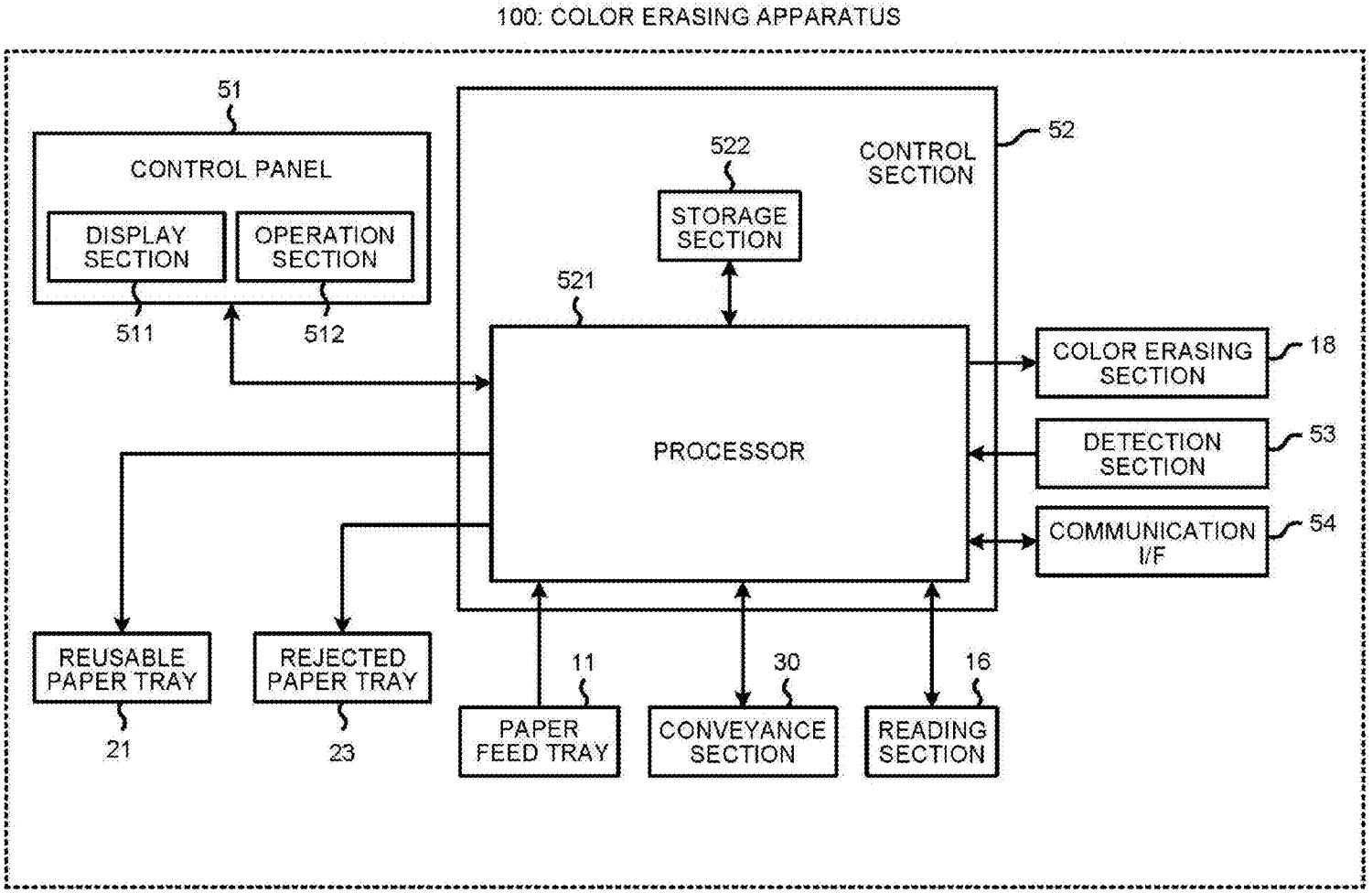
FIG. 2 is a block diagram illustrating an example of the hardware constitution of the color erasing apparatus according to the embodiment.

FIG. 2 is a block diagram illustrating the hardware constitution of the color erasing apparatus 100. The color erasing apparatus 100 comprises the control section 52, a processor 521, the storage section 522, a detection section 53, a communication interface (communication I/F) 54, a conveyance section 30, the reading section 16, the color erasing section 18, a conveyance path 30 and the control panel 51.

The control section 52 controls each section inside the apparatus based on a signal from the detection section 53. The detection section 53 includes the detection sensor Si, the temperature sensors 19*a* and 19*b*, the sheet detection sensors 491-499 and the like shown in FIG. 1.

The control section 52 comprises the processor 521 including a CPU (Central Processing Unit) or a MPU (Micro Processing Unit), and the storage section 522. The control section 52 controls the reading section 16, the color erasing section 18 and the control panel 51. The storage section 522, which is, for example, a semiconductor memory, consists of a ROM (Read Only Memory) for storing various control programs and a RAM (Random Access Memory) for providing a temporary working area for the processor 521. For example, the ROM stores a sheet printing ratio serving as a threshold value for determining the reusability of a sheet, a concentration threshold value for determining whether or not the color of the image is erased. The RAM may temporarily store the image read by the reading section 16. Each component of the color erasing apparatus 100 is connected with each other through a bus line.

The color erasing apparatus 100 carried out, for example, reading processing, color erasing processing and sorting processing. The control section 52 controls the reading section 16, the color erasing section 18 and other component in response to the set processing.

In the reading processing, the control section 52 stores the image read by the reading section 16 in the storage section 522. In the color erasing processing, the control section 52 drives the color erasing section 18 to erase the image formed on the sheet with the color erasable material.

In the sorting processing, the control section 52 determines whether or not the sheet is reusable based on the image read by the reading section 16. The control section 52 determines whether or not there is an image on the sheet based on the data read by the reading section 16. In a case where there are images on both sides of the sheet, the sheet is not reusable. In a case of reading the sheet subjected to the color erasing processing by the color erasing section 18, if the images on both sides of the sheet are all erased, the sheet is determined to be a both sides reusable sheet, and if the image is not erased and left on one single side of the sheet merely, the sheet is determined to be a single side reusable sheet.

The control section 52 controls each component inside the apparatus based on the signal from the detection section 53. The detection section 53 includes the detection sensor Si, the temperature sensors 19*a* and 19*b* and the sheet detection sensors 491~499 shown in FIG. 1. The detection section 53 further includes a detection sensor (not shown) for detecting the quantity of the sheets stacked in the reusable paper tray 21 and the rejected paper tray 23, and the like. The control section 52 determine whether or not there is a sheet on the paper feed tray 11 based on the signal from the detection sensor S1.

The control section 52 detects and controls, using the temperature sensors 19*a* and 19*b*, the temperature of the heating sections of the color erasing units 18*a* and 18*b*. The control section 52 acquires the position of the sheet in the first-fourth conveyance path 31-34 using the sheet detection sensors 491-499. For example, the control section 52 detects the sheet which has passed through the reading section 16 using the sheet detection sensor 491 nearby the downstream side of the reading section 16.

The storage section 522 stores application programs and basic software. The application programs include a program for executing the reading function of the reading section 16 and the color erasing function of the color erasing section 18. The application programs further include a Web client application (Web browser) and other applications. The storage section 522 stores the image read by the reading section 16. Further, the storage section 522 stores the number of the sheets processed by the color erasing apparatus 100. The storage section 522 may be, for example, a hard disk drive or other magnetic storage device, an optical type storage device, semiconductor storage device such as a flash memory and the like, or any combination of these devices.

The communication I/F 54, which is an interface connected with an external machine, communicates with an external device via a network through a proper wireless or wired communication based on IEEE802.15, IEEE802.11, IEEE802.3 and IEEE3304 and the like such as Bluetooth (registered trademark), infrared ray connection and optical connection. The communication I/F 54 may include a USB connection section connected with a connection terminal of a USB standard, a parallel Interface and the like.

The control section 52 communicates with a multi-functional machine and other external machines through the communication I/F 54. For example, the image read by the reading section 16 is stored in the storage section 522 of the color erasing apparatus 100, however, the present invention is not limited to this. For example, a communication may be carried out with a user terminal or the multi-functional machine or a server serving as the external machines through the communication I/F 54 to store the image in the storage sections of these external machines. The image data stored in the external machine may be read from the user terminal or the operation section of the multi-functional machine.

In a case where the color erasing apparatus 100 comprises a login and logout function for carrying out individual authentication of a user, when logging out of the color erasing apparatus 100, the data of the image stored in the RAM or the storage section 522 of the color erasing apparatus 100 may be sent to and stoted in the external device.

The conveyance section 30 is provided with a plurality of conveyance rollers arranged in the first conveyance path 31, the second conveyance path 32, the third conveyance path 33 and the fourth conveyance path 34, and conveyance motors for driving the conveyance rollers. The control section 52 controls the driving of the conveyance motors of the conveyance section 30 so as to control the conveyance speed the sheet. Herein, the speed of the sheet conveyed in the reading section 16 for reading the image of the sheet is referred to as a reading speed, and the speed of the sheet conveyed in the color erasing section for erasing the color of the image on the sheet is referred to as a color erasing speed.

Figure 3:
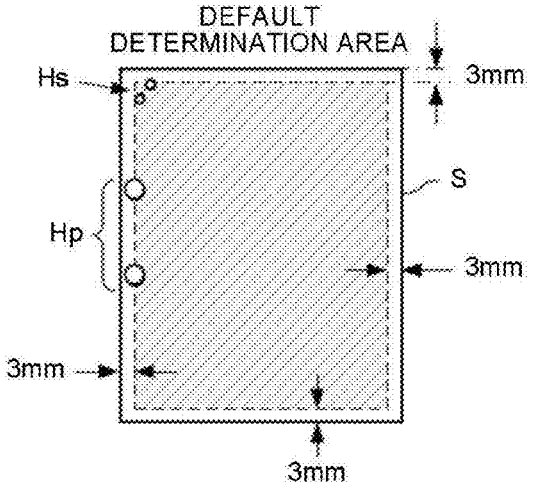
FIG. 3 is a diagram illustrating an example of a default color erasing target area.
Figure 4:
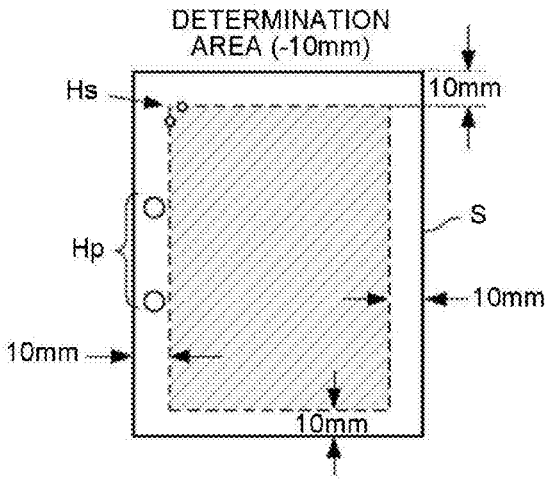
FIG. 4 is a diagram illustrating a specific example of an arbitrary color erasing target area.
Figure 5:
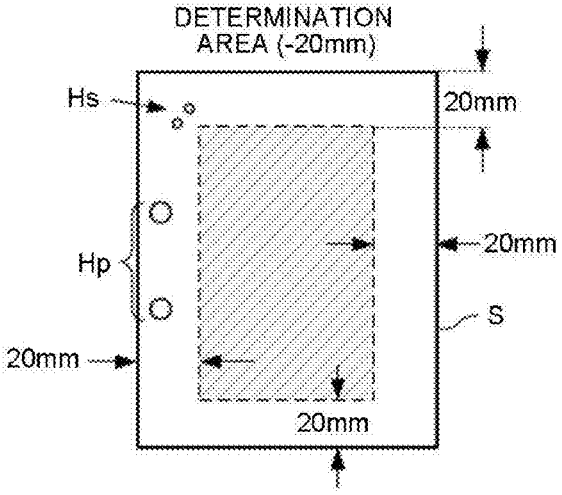
FIG. 5 is a diagram illustrating another specific example of an arbitrary color erasing target area.

FIG. 3-FIG. 5 are diagrams illustrating an example of areas where the reading section 16 reads the sheet S and determines whether to reuse the sheet or to reject the sheet. In addition, the positions of a punched hole Hp and a staple hole Hs on the sheet S are shown in each drawing. Though both the punched hole Hp and the staple hole Hs are shown on the sheet S in the present embodiment, generally, only one of the punched hole Hp and the staple hole Hs is formed on the sheet. For the convenience of description, both holes are shown on one sheet S.

FIG. 3 shows an example of a preset default reading area where the reading section 16 reads the sheet S. The reading area shown in FIG. 3 is the inside area which is 3 mm away from the upper and lower edge of the sheet in the vertical direction, and 3 mm away from the left and right edge of the sheet in the horizontal direction, and the reading area is scanned and read by the first reading unit 16*a* and the second reading unit 16*b* of the reading section 16. During a process of reading the image on the sheet S in the directions of an X axis and Y axis by the first and the second reading units 16*a* and 16*b*, the control section 52 can use an existing module such as changing the start timing of the scanning in a horizontal scanning direction and a vertical scanning direction of the X axis and the Y axis. Alternatively, as to the read image data, a marking processing is carried out on the data in the inside area (reading area) which is 3 mm away from the upper and lower edge of the sheet in the vertical direction and 3 mm away from the left and right edge of the sheet in the horizontal direction, and the data in an outside area is replaced with white data, thereby setting the designated range as the reading area.

FIG. 4 and FIG. 5 show an example of operating the control panel 51 to arbitrarily set the reading area. The reading area shown in FIG. 4 is set so that the reading section 16 scans the inside area which is 10 mm away from the upper and lower edge of the sheet S in the vertical direction, and 10 mm away from the left and right edge of the sheet S in the horizontal direction. The reading area shown in FIG. 5 is set so that the reading section 16 scans the inside area which is 20 mm away from the upper and lower edge of the sheet S in the vertical direction, and 20 mm away from the left and right edge of the sheet S in the horizontal direction. In addition, the reading area may be set by operating, for example, the numeric keypad of the operation section 512 of the control panel 51.

The staple hole Hs is in the reading area in FIG. 4. The staple hole Hs can be read by the reading section 16. FIG. 5 illustrates a case where neither of the punched hole Hp and the staple hole Hs is in the reading area.

Both the punched hole Hp and the staple hole Hs are in the reading area of the sheet S shown in FIG. 3. In this case, the sheet is to be rejected. The punched hole Hp is not in the reading area while the staple hole Hs is in the reading area of the sheet shown in FIG. 4, thus, in this case, the sheet is also to be rejected.

In addition, the punched hole Hp and the staple hole Hs shown in FIG. 3 and the staple hole Hs shown in FIG. 4 are not entirely included in the reading area. In this case, the detected amount of the punched hole Hp or the staple hole Hs read by the first and the second reading units 16*a* and 16*b* is compared with a preset threshold value, and the result of the comparison can be used in the determination on whether to reuse or reject the sheet.

In a case where there is a punched hole Hp or a staple hole Hs on the sheet S, the sheet S is stacked in the rejected paper tray 23 regardless of the color erasing state of the image on the sheet S. In a case where there is a punched hole Hp or a staple hole Hs on the sheet, but the detected amount value is smaller than the preset threshold value, the sheet can be reused.

As stated above, even in a case where there is a punched hole Hp or a staple hole Hs on the sheet S, the reading area is restricted to include or not include the hole. In this way, the target range of reusable sheet can be enlarged.

Figure 6:
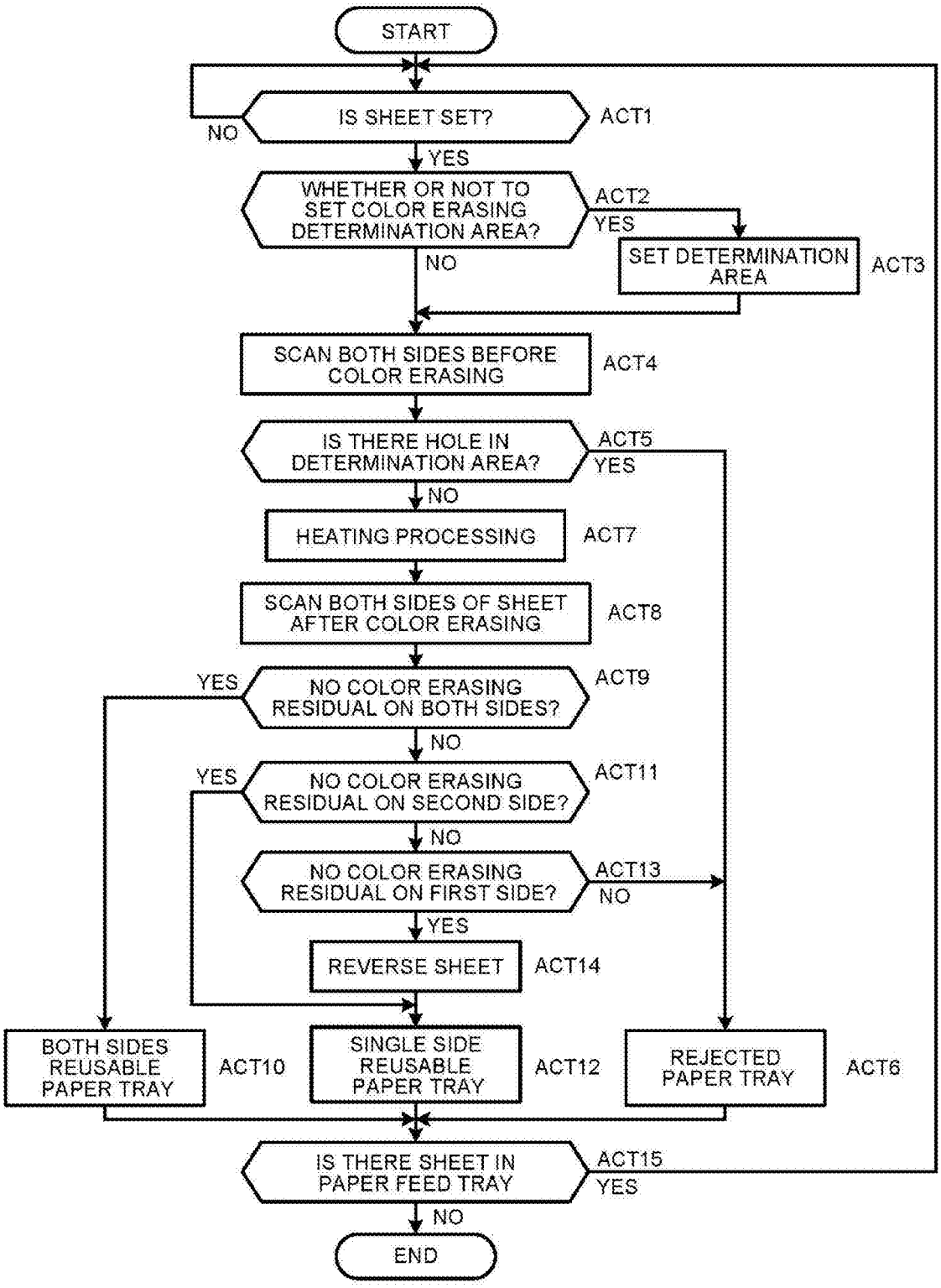
FIG. 6 is a flowchart illustrating an example of a sorting processing carried out in the color erasing apparatus according to the embodiment.

FIG. 6 is a flowchart illustrating an example of a sorting processing which is carried out after the color erasing processing and relates to a punched hole and a staple hole in the color erasing apparatus 100 according to the embodiment.

If a color erasing processing mode is selected from the control panel 51, and the color erasing processing is started, the control section 52 of the color erasing apparatus 100 takes out one sheet S from the paper feed tray 11 and conveys the sheet to the first conveyance path 31 (ACT 1).

The control section 52 displays a message of "whether or not to set the color erasing reading area of the sheet S" on the control panel 51 to urge the user to make a choice (ACT 2).

If the user selects to set the reading area in ACT 2 (YES), the flow proceeds to ACT 3 to set a reading area from the control panel 51, and then the flow proceeds to ACT 4. If the user selects not to set the reading area in ACT 2 (NO), the flow proceeds to ACT 4.

In ACT 4, the control section 52 reads, using the first and the second reading units 16*a* and 16*b*, the first (front) side and the second (rear) side of the sheet S conveyed to the reading section 16 to generate image data. If the color erasing reading area is the default reading area (NO in ACT 2), the control section 52 carries out both sides scanning processing on the reading area shown in FIG. 3 before the color erasing processing is carried out. If the color erasing reading area is the set reading area (YES in ACT 2), the control section 52 carries out both sides scanning processing on, for example, the reading area shown in FIG. 4 or FIG. 5 before the color erasing processing is carried out, and then the flow proceeds to ACT 5.

If it is determined that there is a punched hole Hp or a staple hole Hs in the reading area in ACT 5 (YES), the target sheet S is stacked in the rejected paper tray 23 (ACT 6). In this case, the sheet is not subjected to the color erasing processing by the color erasing section 18, which contributes to the power saving; and the time taken for the determination is shortened, which also contributes to the power saving.

If it is determined that there is no punched hole Hp or staple hole Hs in the reading area in ACT 5 (NO), the flow proceeds to ACT 7.

In ACT 7, the control section 52 rotates the first flapper F1 anticlockwise to convey the sheet S to the second conveyance path 32, and heats the image on the sheet to erase the color of the image using the color erasing section 18.

The control section 52 conveys the sheet passing through the color erasing section 18 to the reading section 16 to read the image information of the sheet again (ACT 8).

The control section 52 determines whether or not there is color erasing residual according to the image information of the both sides of the sheet read by the reading section 16 in ACT 8 (ACT 9).

If it is determined that there is no image color erasing residual on both sides of the sheet in ACT 9 (YES), the flow proceeds to ACT 10. The control section 52 rotates the first flapper F1 clockwise and the second flapper F2 anticlockwise, and drives the discharge roller 25 to stack the sheet in the both sides reusable paper tray 21 to reuse the both sides of the sheet.

If it is determined that there is image color erasing residual on both sides of the sheet in ACT 9 (NO), the flow proceeds to ACT 11 to determine whether or not there is color erasing residual on the second (rear) side of the sheet.

If it is determined that there is no image color erasing residual on the second side of the sheet in ACT 11 (YES), the flow proceeds to ACT 12.

In ACT 12, the control section 52 respectively rotates the first and the second flappers F1 and F2 clockwise and rotates the third flapper F3 anticlockwise. Further, the control section 52 drives the discharge roller 26 to stack the sheet in the single side reusable paper tray 22 to reuse the single side of the sheet.

If it is determined that there is no image color erasing residual on the second side of the sheet in ACT 11 (NO), the flow proceeds to ACT 13 to determine whether or not there is color erasing residual on the first (front) side of the sheet.

If it is determined that there is no image color erasing residual on the first side of the sheet in ACT 13 (YES), the flow proceeds to ACT 14.

In ACT 14, the control section 52 rotates the second flapper F2 anticlockwise and conveys the sheet to the sheet reversal section 24 (not shown, refer to FIG. 1). Further, the control section 52 reversely rotates the discharge roller 25, and rotates the fourth flapper F4 anticlockwise to convey the sheet to the third conveyance path 33.

The control section 52 rotates the third flapper F3 anti-clockwise and drives the discharge roller 26 to stack the sheet in the single side reusable paper tray 22.

If it is determined that there is image color erasing residual on the first side of the sheet in ACT 13 (NO), the flow proceeds to ACT 6, and the second and the third flappers F2 and F3 are rotated clockwise, respectively. Then, the sheet is conveyed through the third and the fourth conveyance paths 33 and 34 and the discharge roller 27, and then stacked in the rejected paper tray 23.

During the sorting processing of distributing the sheets S stacked in the paper feed tray 11 to the both sides reusable paper tray 21, the single side reusable paper tray 22 and the rejected paper tray 23, the control section 52 carries out a determination on the existence of sheet on the paper feed tray 11 using the detection sensor Si (ACT 15).

If it is determined that there is a sheet S on the paper feed tray 11 in ACT 15 (YES), the flow returns to ACT 1 to continue the sorting processing. If it is determined that there is no sheet S on the paper feed tray 11 (NO), the sheet sorting processing is ended.

As stated above, if there is a punched hole Hp or a staple hole Hs on the sheet S in the reading area, the sheet S is to be rejected. If there is a punched hole Hp or a staple hole Hs on the sheet S outside the reading area, whether to reuse or reject the sheet S depends on the color erasing state of the sheet. In this way, the number of sheets to be reused can be increased.

In the embodiment described herein, the sheet, which has a punched hole Hp or a staple hole Hs and therefore is supposed to be excluded from the reuse target sheets, can be reused. It is expected to increase the number of the reuse target sheets, which contributes to the reduction of the environmental load.

The coordinate of the area excluded from the determination can be selected using a touch panel or a keyboard, or through the Web, in this way, the reuse rate of sheets can be improved according to a user intended sheet use condition.

Further, in addition to the existence of the color erasing residual, the punched hole or the staple hole on the sheet, the sheet is also rejected duo to the existence of other holes formed through other modules. The reading section further takes a rip, a stain and the like on the sheet as the reading target, and if a rip or a stain and the like are detected, the sheet is stacked in the rejected paper tray without being subjected to the color erasing processing by the color erasing section.

Moreover, only a color erasing apparatus single body is described in the embodiment stated above. The color erasing apparatus may be a multi-functional machine which comprises an image forming function.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A color erasing apparatus capable of erasing the color of an image formed with a color erasable material on a sheet, comprising:

a color erasing section configured to erase the color of an image formed on the sheet;

a control panel configured to set an area to scan the sheet;

a reading section configured to scan and read the image of the area set on the sheet; and a control section configured to determine a state of the image erased by the color erasing section.

2. The color erasing apparatus according to claim 1, wherein the reading section is capable of detecting a punched hole or a staple hole in the reading area, and if the hole is detected, the sheet is not to be reused.

3. The color erasing apparatus according to claim 1, wherein the color erasing section is capable of erasing the color of the image through a heating processing.

4. The color erasing apparatus according to claim 1, wherein the reading area of the reading section is set a default value if there is no changing command.

5. The color erasing apparatus according to claim 1, wherein the sheet on which a hole is detected in the reading area by the reading section is rejected without being subjected to a color erasing processing by the color erasing section.

6. The color erasing apparatus according to claim 1, wherein the single side reusable sheets within the sheets subjected to the color erasing processing are discharged in such a manner that the reusable sides of the sheets face to the same direction.

7. The color erasing apparatus according to claim 1, wherein the reading section carries out a reading processing to determine whether the sheet is a both sides reusable sheet, a single side reusable sheet or a rejected sheet, and the sheets are sorted and stacked in different trays according to the reading result.

8. The color erasing apparatus according to claim 7, wherein the trays for stacking the both sides reusable sheet, the single side reusable sheet and the rejected sheet can switch between the both sides reusable sheet, the single side reusable sheet and the rejected sheet to be stacked.

9. The color erasing apparatus according to claim 1, wherein it is possible to set to carry out a reading, determining and sorting processing on a sheet without passing the sheet through the color erasing section.

10. The color erasing apparatus according to claim 1, wherein if it is determined, according to a color erasing state of the both sides of the sheet, that only a single side of the sheet can be reused, a marking processing indicating "not-reusable" is carried out on the non-reusable side.

11. A color erasing method capable of erasing the color of an image formed with a color erasable material on a sheet, comprising:

erasing the color of an image formed on the sheet by a color erasing section;

setting a reading an area to scan the sheet by a control panel;

reading, by the reading section, the image of the area set on the sheet; and determining, by control section, a state of the image erased by the color erasing section.

12. The method according to claim 11, wherein the reading section is capable of detecting a punched hole or a staple hole in the reading area, and if the hole is detected, the sheet is not to be reused.

13. The method according to claim 11, wherein
the color erasing section is capable of erasing the color of the image through a heating processing.

14. The method according to claim 11, wherein
the reading area of the reading section is set a default value if there is no changing command.

15. The method according to claim 11, wherein
the sheet on which a hole is detected in the reading area by the reading section is rejected without being subjected to a color erasing processing by the color erasing section.

16. The method according to claim 11, wherein
the single side reusable sheets within the sheets subjected to the color erasing processing are discharged in such a manner that the reusable sides of the sheets face to the same direction.

17. The method according to claim 11, wherein
the reading section carries out a reading processing to determine whether the sheet is a both sides reusable sheet, a single side reusable sheet or a rejected sheet, and the sheets are sorted and stacked in different trays according to the reading result.

18. The method according to claim 17, wherein
the trays for stacking the both sides reusable sheet, the single side reusable sheet and the rejected sheet can switch between the both sides reusable sheet, the single side reusable sheet and the rejected sheet to be stacked.

19. The method according to claim 11, wherein
it is possible to set to carry out a reading, determining and sorting processing on a sheet without passing the sheet through the color erasing section.

20. The method according to claim 11, wherein
if it is determined, according to a color erasing state of the both sides of the sheet, that only a single side of the sheet can be reused, a marking processing indicating "not-reusable" is carried out on the non-reusable side.

* * * * *